US011849826B2

(12) United States Patent
Kaufman et al.

(10) Patent No.: US 11,849,826 B2
(45) Date of Patent: Dec. 26, 2023

(54) FALSE BOTTOM BAG AND INSERT

(71) Applicant: CAMP NYC, INC., New York, NY (US)

(72) Inventors: Benjamin Kaufman, New York, NY (US); Scott P. Shephard, New York, NY (US)

(73) Assignee: CAMP NYC, INC., New York, NY (US)

( * ) Notice: Subject to any disclaimer, the term of this patent is extended or adjusted under 35 U.S.C. 154(b) by 2 days.

(21) Appl. No.: 17/689,028

(22) Filed: Mar. 8, 2022

(65) Prior Publication Data

US 2022/0279905 A1 Sep. 8, 2022

Related U.S. Application Data

(60) Provisional application No. 63/157,910, filed on Mar. 8, 2021.

(51) Int. Cl.
*A45C 3/04* (2006.01)

(52) U.S. Cl.
CPC ..... *A45C 3/04* (2013.01); *A45C 2200/00* (2013.01)

(58) Field of Classification Search
CPC ..... A45C 3/04; A45C 2200/00
See application file for complete search history.

(56) References Cited

U.S. PATENT DOCUMENTS

| | | | |
|---|---|---|---|
| 2008/0105695 | A1 | 5/2008 | Moran et al. |
| 2009/0223850 | A1 | 9/2009 | Katzauer et al. |
| 2015/0344182 | A1 | 12/2015 | Malin |
| 2018/0168305 | A1 | 6/2018 | Daily |

FOREIGN PATENT DOCUMENTS

| | | |
|---|---|---|
| DE | 8612792 | 7/1986 |

OTHER PUBLICATIONS

PCT International Search Report dated Jun. 2, 2022 from corresponding International Application No. PCT/US22/19249 filed Mar. 8, 2022.

*Primary Examiner* — Tri M Mai
(74) *Attorney, Agent, or Firm* — Grogan, Tuccillo & Vanderleeden, LLP

(57) ABSTRACT

A bag having a hidden compartment includes a plurality of sides connected to a bottom portion, the sides and bottom portion forming an interior cavity of the bag. The bag further including an insert secured to a least one side of the bag within the interior cavity via an attachment mechanism, the insert having an upper surface, an underside surface, and a panel portion that is removable from the insert via one or more tear lines. The insert including a compartment secured to the underside surface of the insert and wherein the panel portion forms a removable false bag bottom and hides the compartment from view.

14 Claims, 12 Drawing Sheets

FALSE BOTTOM BAG AND INSERT

CROSS-REFERENCE TO RELATED APPLICATIONS

This application claims the benefit of U.S. Provisional Patent Application Ser. No. 63/157,910, filed on Mar. 8, 2021, the entirety of which is incorporated by reference herein.

BACKGROUND

Technical Field

Embodiments of the invention relate generally to false bottom panels incorporated into bags that create a compartment at the bottom of the bag that is hidden from view and specifically to an insert that allows for a container to be placed below the false bottom panel without hindering the functionality of the bag.

Discussion of Art

In the bag space, e.g., reusable shopping bags, it is desirable to allow for incorporation of a container or compartment inside the bag that is hidden from view without hindering the functionality of the bag. To accomplish this, it is necessary to create an insert that affixes to the bag to hide the container. It is difficult, however, to incorporate a hidden container into a bag without hindering the functionality of the bag both when the container is placed within the bag and after the container is removed from the bag.

What is needed, therefore, is an insert that provides a false bottom panel to the bag to hide a container from view and that is at least partially removeable to reveal the container and that also allows for normal functionality of the bag when the container is contained therein and also when it is removed from the bag.

SUMMARY

In an embodiment, a bag having a hidden compartment includes a plurality of sides connected to a bottom portion, the sides and bottom portion forming an interior cavity of the bag. The bag further including an insert secured to a least one side of the bag within the interior cavity via an attachment mechanism, the insert having an upper surface, an underside surface, and a panel portion that is removable from the insert via one or more tear lines. The insert including a compartment secured to the underside surface of the insert and wherein the panel portion forms a removable false bag bottom and hides the compartment from view.

In another embodiment, an insert that may be secured within a cavity of a bag via an attachment mechanism includes an upper surface, an underside surface, and a panel portion that is removable from the insert via one or more tear lines. The insert further includes a compartment secured to the underside surface of the insert, and wherein the panel portion forms a removable false bag bottom and hides the compartment from view when installed in a cavity of a bag.

DRAWINGS

The present invention will be better understood from reading the following description of non-limiting embodiments, with reference to the attached drawings, wherein below:

DETAILED DESCRIPTION

Figure 2:
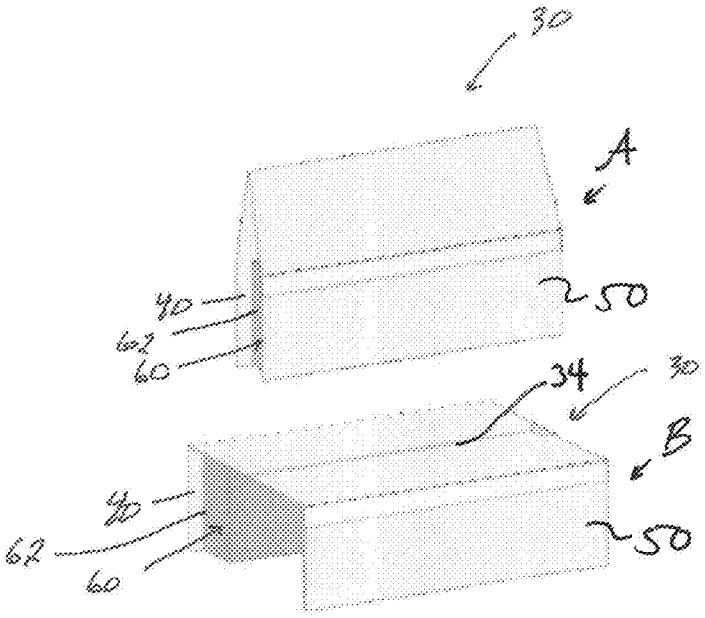
FIG. 2 depicts an insert in a collapsed state and an open state, in accordance with an embodiment of the present invention.

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly.

Embodiments of the present invention are described as for use with reusable bags, e.g., shopping bags, which can be made from woven or non-woven materials including, but not limited to, fabrics made from natural fibers or synthetic fibers, plastics, and other suitable materials. Other embodiments may be used with single use bags. As will be appreciated, the invention is not limited to bags of certain materials or for specific uses, rather embodiments are for use with bags generally.

Embodiments provide a hidden compartment or container that may be preloaded with an item such as a toy or gift. In other embodiments, a user may receive a bag with an empty container/compartment and place an item in the same to keep it hidden from view. While in some embodiments, the bags are depicted without handles, it is contemplated that they will include handles secured to sides of the bag for ease of use/transportation.

Figure 1:
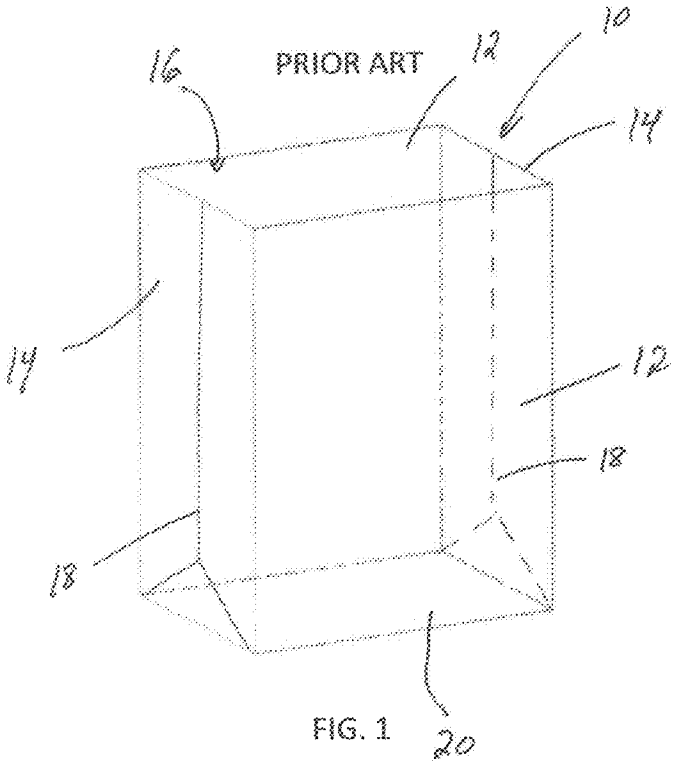
FIG. 1 depicts a prior art bag compatible with the insert disclosed in the present application.

FIG. 1 depicts a prior art shopping bag in the form of a rectangular bag 10 having a plurality of sides connected to bottom portion to define an interior cavity. More specifically, the bag has a length that is defined by two opposing length sides 12 and a width defined by two opposing width sides 14. The sides 12, 14 structurally define an internal cavity 16. A bag fold 18 extends along a length of the width sides 14 from the opening of the cavity 16 to a bottom surface 20 of the bag 10. As discussed below, certain embodiments of the invention may be utilized with such bags 10, while other embodiments are configured for use with bags that include attachment mechanisms secured to or within the cavity of the bag.

Figure 4:
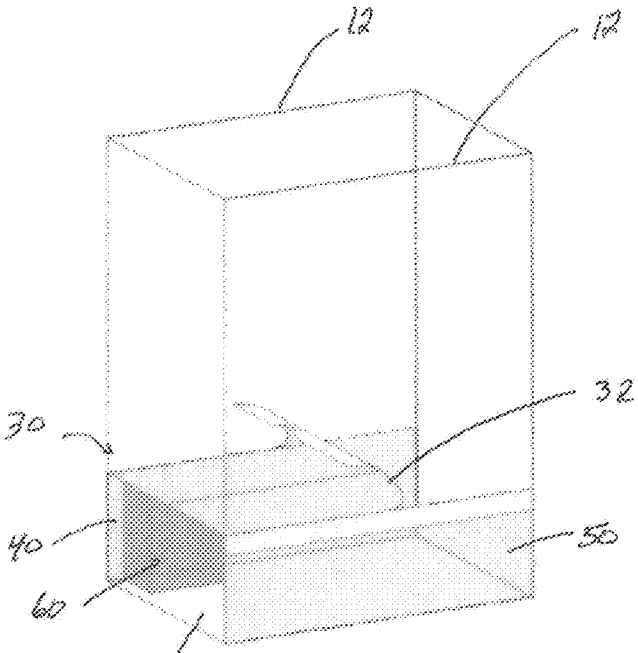
FIG. 4 depicts the insert of FIG. 3 with the panel portion partially removed, with the bag depicted in phantom for clarity purposes.
Figure 3:
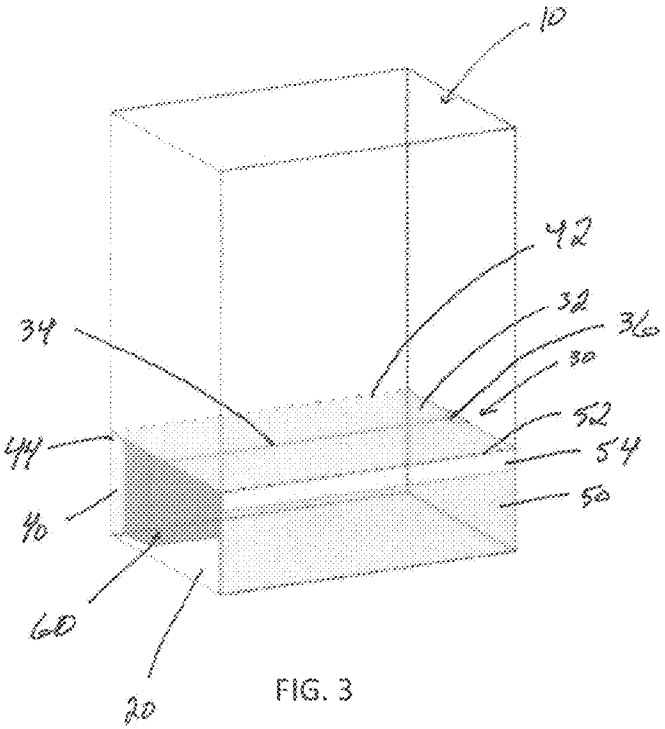
FIG. 3 depicts the insert of FIG. 2 installed in the bag of FIG. 1, with the bag depicted in phantom for clarity purposes.

Referring now to FIGS. 2-4, an embodiment of an inventive insert 30 as installed in a bag 10 is shown. The insert 30 may be used with bag 10 to add a hidden compartment or container 60 to the bag 10. As depicted, the insert 30 includes a panel portion 32 disposed between, when installed, downwardly depending leg portions, e.g., a first insert leg 40 and a second insert leg 50. As shown in FIG. 4, these leg portions are substantially perpendicular to the panel portion 32 when secured within the bag 10.

The panel portion 32 includes an upper surface or portion and an underside surface or portion to which the hidden compartment 60 is attached. When installed, the upper surface of the panel portion 32 forms a false bottom surface to the bag 10, so that the container 60 is hidden from view. In the depicted embodiment, the panel portion 32, the first insert leg 40, and the second insert leg 50 are formed by a single sheet of material interrupted by folds 42, 52, but incorporating separate pieces of material does not depart from the invention disclosed herein. In embodiments, the insert 30 is manufactured from a sheet of cardboard or similar material, though other materials may be utilized.

Referring to FIGS. 3 and 4, each of the first insert leg 40 and the second insert leg 50 includes attachment mechanisms 44, 54 (e.g., double sided tape or adhesive, snaps, hook and loop connectors, etc.) affixing each insert leg 40, 50 to an opposite side of the bag 10. In certain embodiments, the attachment mechanisms 44, 54 includes a mating portion of the means secured to one or more sides 12, 14 of the cavity 16. For example, the insert 30 may include the hook portion of the attachment mechanism and the cavity of the bag may include the loop portion. In certain embodiments, the cavity 16 may include reinforced pockets that are affixed or integral to the bag cavity 16. These pockets are configured to receive an insert leg 40, 50. The pockets may include an attachment mechanism such as hooks/loops that mate with a corresponding attachment mechanism on the leg 40, 50.

In the embodiment depicted in FIGS. 2-5, the attachment mechanisms 44, 54 affix the insert legs 40, 50 to the length sides 12 of the bag 10, but affixing the insert legs 40, 50 to other surfaces of the bag 10 does not depart from the invention disclosed herein. Each of the folds 42, 52 is perforated to form a tear line to allow efficient removal of the panel portion 32 from the insert 30, via pulling the panel portion 32 upwards thereby tearing it away along the folds, without disturbing the first insert leg 40 and the second insert leg 50 (FIG. 4). In certain embodiments (not depicted), the folds/tear lines 42, 52 are not perforated, but still allow for removal of the panel portion 32 without disturbing the insert legs 40, 50 via, e.g., a thinner/weaker portion or line of material.

As shown in FIG. 2, a central fold 34 bifurcates the panel portion 32 to allow the insert 30 to collapse from an open state A to a collapsed state B. The central fold 34 allows the insert 30 to collapse for storage of the insert 30 alone and/or when already installed in the bag 10. In embodiments, one end of the central fold 34 terminates at a notch 36 that provides the user with an aperture to easily remove the panel portion 32 (FIG. 3).

Referring to FIG. 2, the panel 32 includes a container 60 that is affixed to the underside of panel 32, along a container retention flap 68 (FIGS. 6-8) extending from a top of container 60, using suitable attachment mechanism (e.g., tape, glue, hook and loop connectors, etc.). The container 60 travels with panel 32 of the insert 30 during both the open state (bottom portion of FIG. 2) and the collapsed state (upper portion of FIG. 2) of the insert 20. A top 64 and/or a bottom 66 of the container 60 releasably secures to the container 60 to allow access to the volume within the container 60 (depicted in detail in FIGS. 6-8, as discussed below).

FIG. 4 depicts the insert 30 of FIG. 3 with the panel portion 32 in the process of being removed from the insert 30. The user (not depicted) pulls the panel portion 32 away from the base 20 of the bag 10 and the panel portion 32 detaches from the first insert leg 40 and the second insert leg 50. Container 60 comes out with panel 32, leaving only the sidewall 40 and 50. Affixing the container 60 to alternate portions of the insert 20 and/or to the bag 10 does not depart from the invention disclosed herein.

Figure 5:
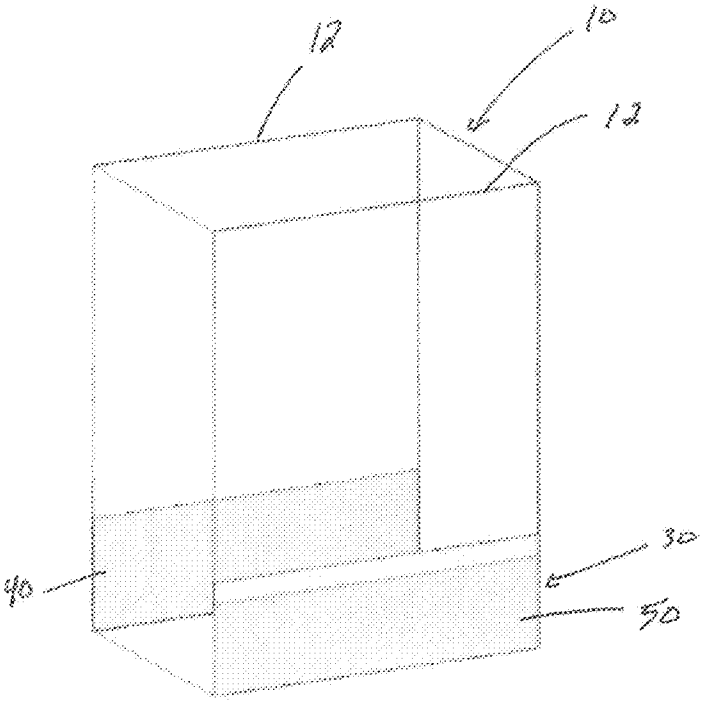
FIG. 5 depicts the insert of FIG. 3 with the panel portion entirely removed, with the bag depicted in phantom for clarity purposes.

Referring to FIG. 5, once the panel portion 32 and the container 60 are removed from within the bag 10, the first insert leg 40 and the second insert leg 50 remain in place, affixed to opposite length sides 12 of the bag 10, allowing for full functionality and use of the volume within the bag 10. An insert 20 that fully removes from the bag 10 to allow access to the container 60 does not depart from the invention disclosed herein.

In certain embodiments, the bottom of the bag 10 may contain a structural reinforcement, with or without an envelope/pocket, e.g., a rigid material, that is laminated, woven, or otherwise attached to the sides of the bag 10. This material may be used to create a structurally stable bag surface that readily accommodates the attachment mechanisms, as well as the shape and weight of the insert, hidden compartment, and any compartment contents.

Figure 7:
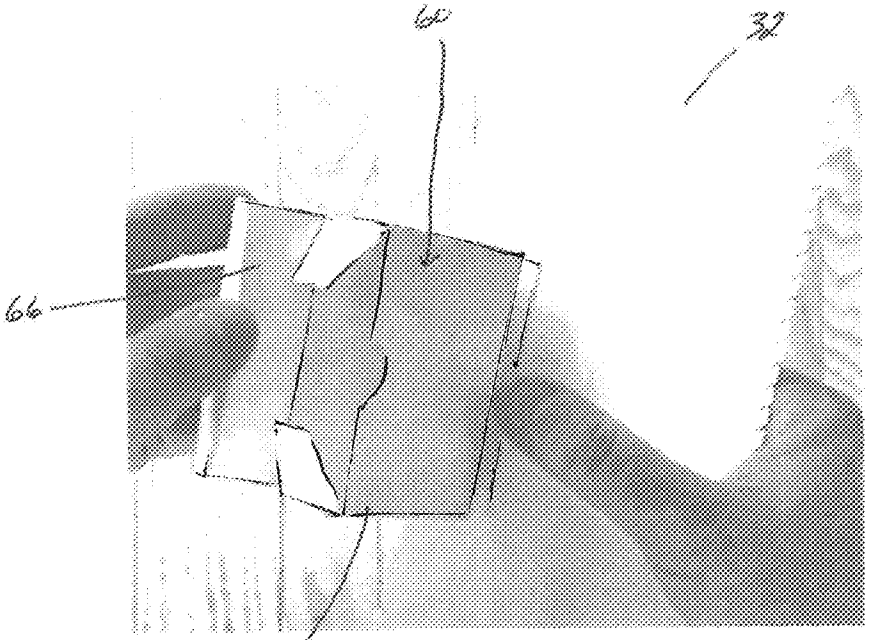
FIG. 7 depicts the container of FIG. 6 in an open state.
Figure 6:
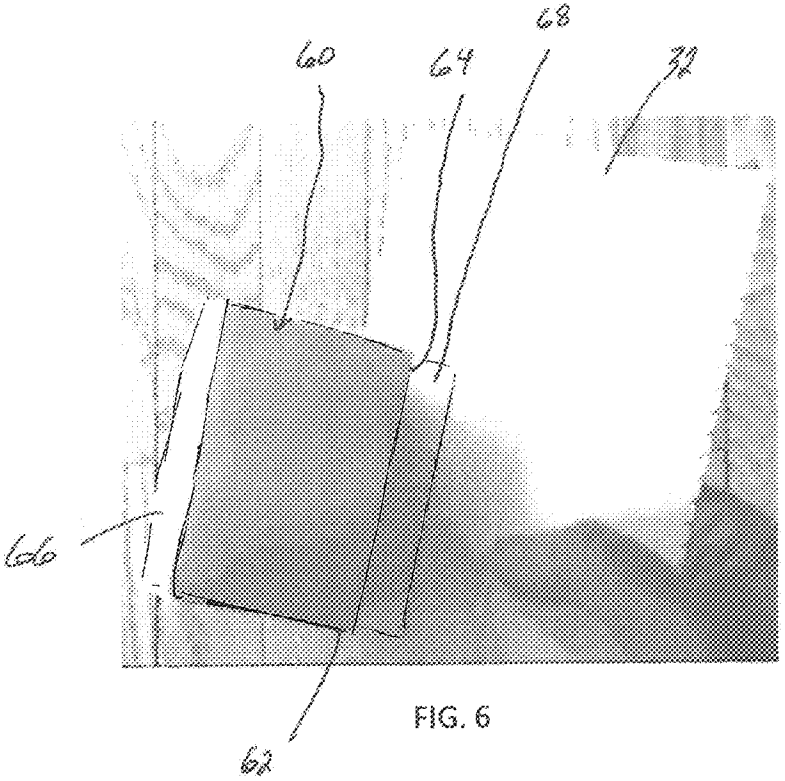
FIG. 6 depicts a container compatible with a panel portion in accordance with an embodiment of the present invention.
Figure 8:
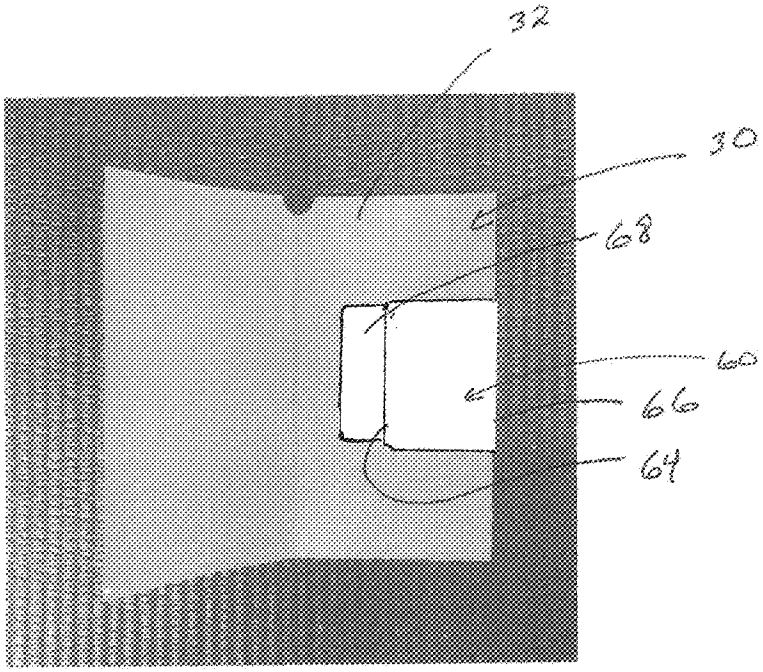
FIG. 8 depicts the container of FIG. 6 attached to an insert of FIGS. 2-5, prior to installation in a bag.
Figure 10:
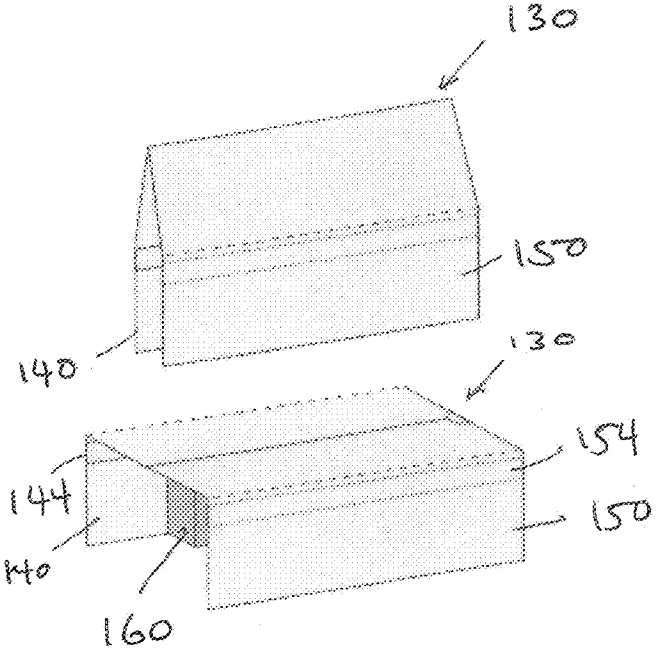
FIG. 10 depicts an insert in a collapsed state and an open state, in accordance with an embodiment of the present invention.

Referring now to FIGS. 6-8, an embodiment of the hidden container 60 is depicted. The container 60 is shown as a rectangular box having an opening to allow access to the interior of the box and the contents therein. In an embodiment, the container 60 includes a retention flap 68 extending from a container sidewall 62 that is adjacent to a container top 64. The retention flap 68 connects the hidden container 60 to the underside of the panel portion 32 of the insert 30 via, e.g., an adhesive. The container bottom 66 releasably secures to the sidewall 62 to allow access to the interior and contents of the hidden container 60. The container is preferably manufactured from a recyclable material, e.g., cardboard or reinforced paper, but a variety of materials may be used. As will be appreciated, the container 60 may have a variety of shapes and may be attached to the underside of the panel portion 32 via an adhesive or other attachment mechanism.

Figure 9:
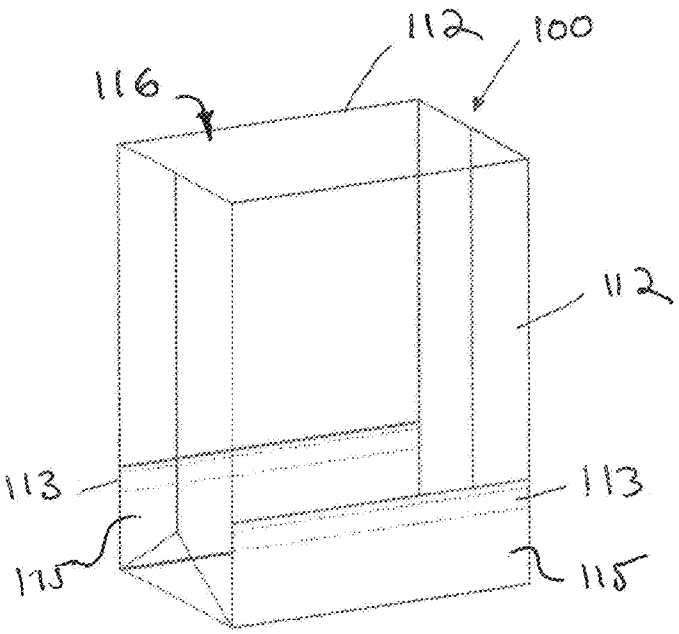
FIG. 9 depicts a bag, including fasteners installed in the bag, according to an embodiment of the present application.
Figure 12:
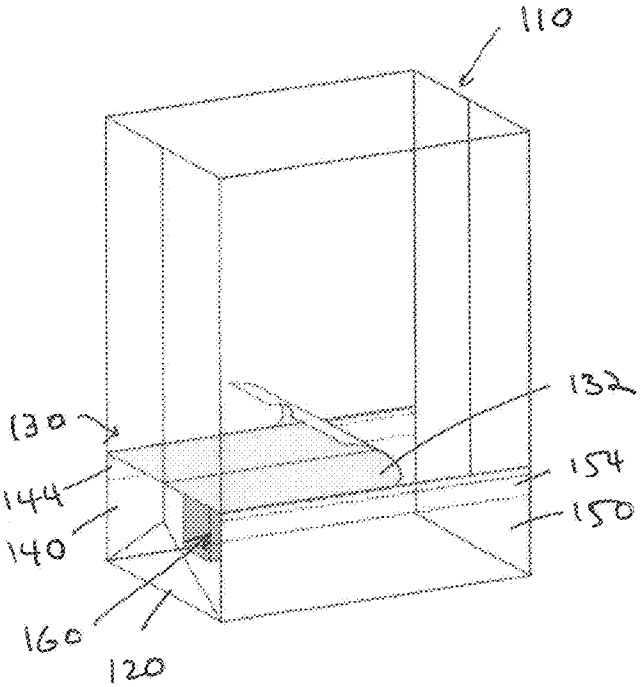
FIG. 12 depicts the insert of FIG. 11 with the panel portion partially removed, with the bag depicted in phantom for clarity purposes.
Figure 11:
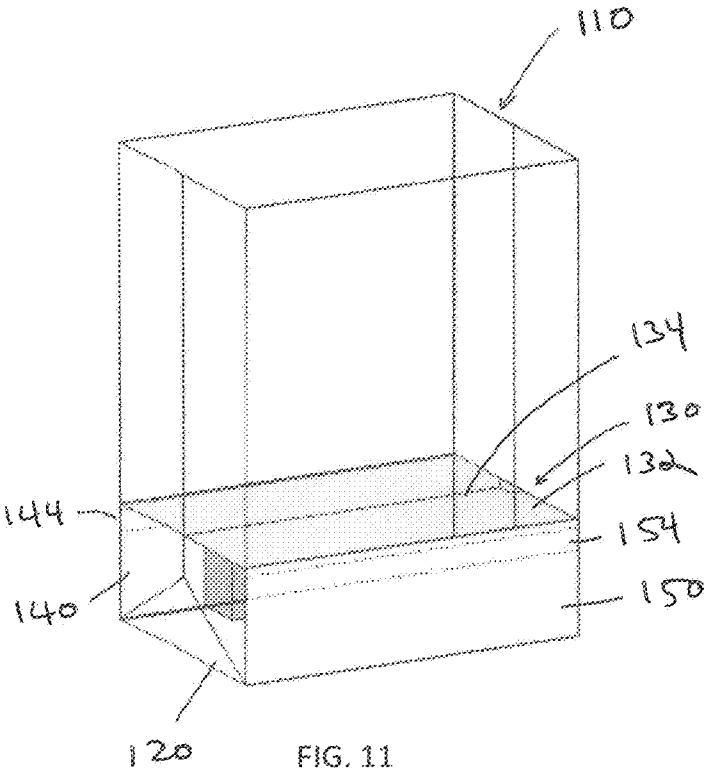
FIG. 11 depicts the insert of FIG. 10 installed in the bag of FIG. 9, with the bag depicted in phantom for clarity purposes.
Figure 13:
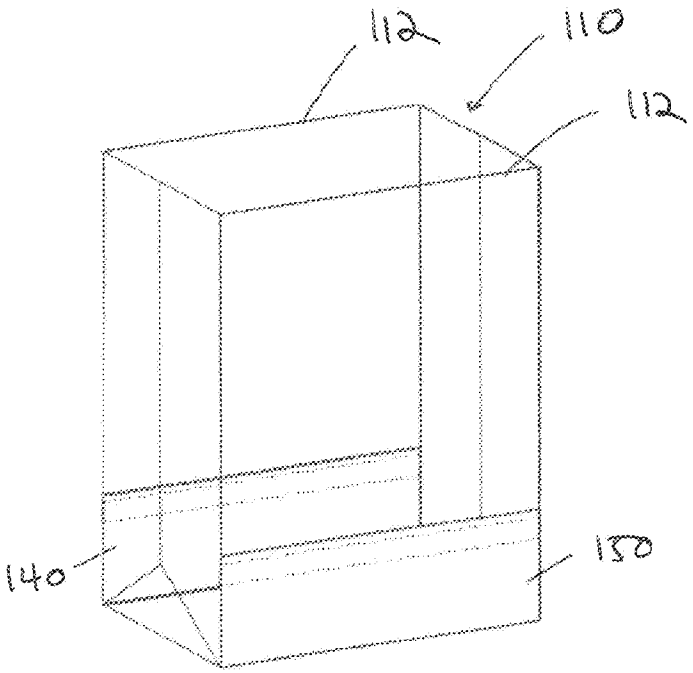
FIG. 13 depicts the insert of FIG. 10 with the panel portion entirely removed, with the bag depicted in phantom for clarity purposes.
Figure 15:
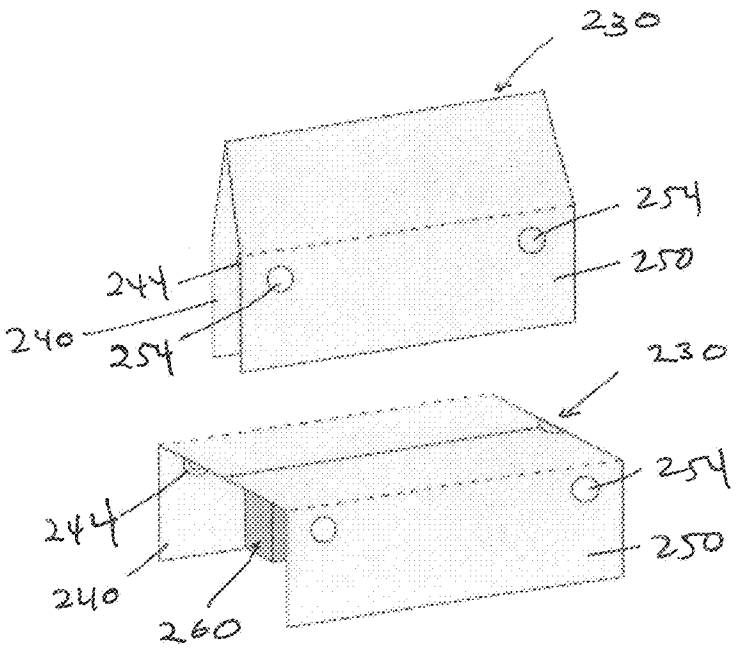
FIG. 15 depicts an insert in a collapsed state and an open state, in accordance with an embodiment of the present invention.

FIG. 9 depicts an alternate embodiment of a bag 110 that incorporates fastening means 113 in the form of one part of a hook and loop connector on each of the length sides 112 of the bag 110. As mentioned, these fastening means/connectors may be located in envelopes or pockets 115 formed in the length sides 112 in the cavity 116 of the bag 100. In such embodiments, the pockets 115 are sized to accommodate the insert legs 140 and 150 when assembled. The insert legs 140, 150 fit within the pockets and are secured therein via mated connectors such that when the panel portion 130 is removed, the insert legs 140, 150 remain within the pockets 115 while the hidden container on the underside of the panel portion 130 is exposed. In other embodiments, the hook and loop connector part of the fastening means 113 may be attached directly to the length sides 112 without a pocket or envelope.

FIGS. 10-13 depict an insert 130 compatible with the bag 110, in accordance with this embodiment. The attachment mechanisms 144, 154, are located on the first insert leg 140 and the second insert leg 150 and have the complementary portion of the hook and loop connectors to releasably secure the first insert leg 140 and the second insert leg 150 to the fastening means 113.

Figure 14:
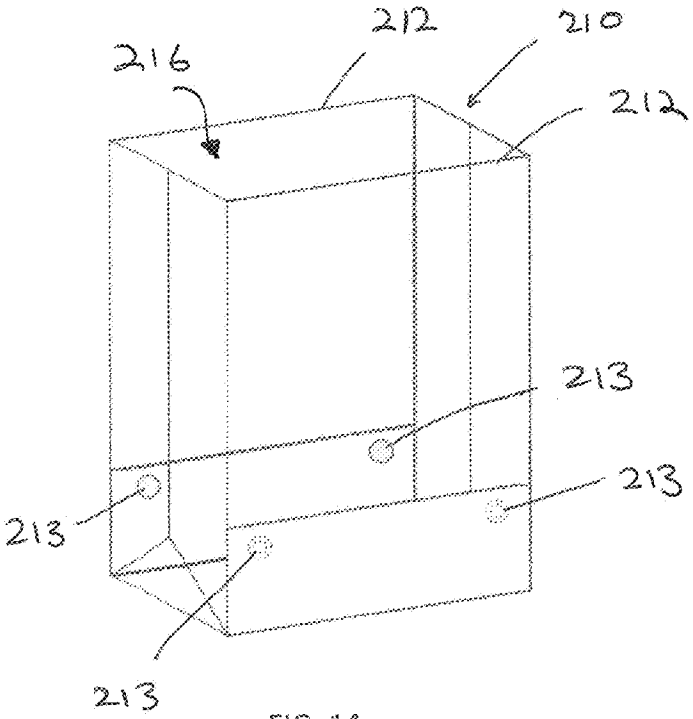
FIG. 14 depicts a bag, including alternate fasteners installed in the bag, compatible with the insert disclosed in the present application.
Figure 17:
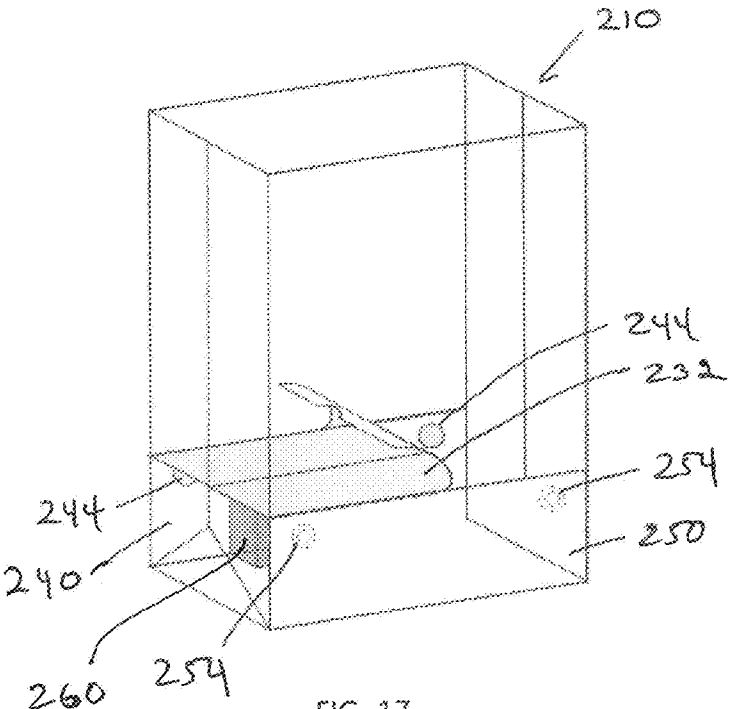
FIG. 17 depicts the insert of FIG. 16 with the panel portion partially removed, with the bag depicted in phantom for clarity purposes.
Figure 16:
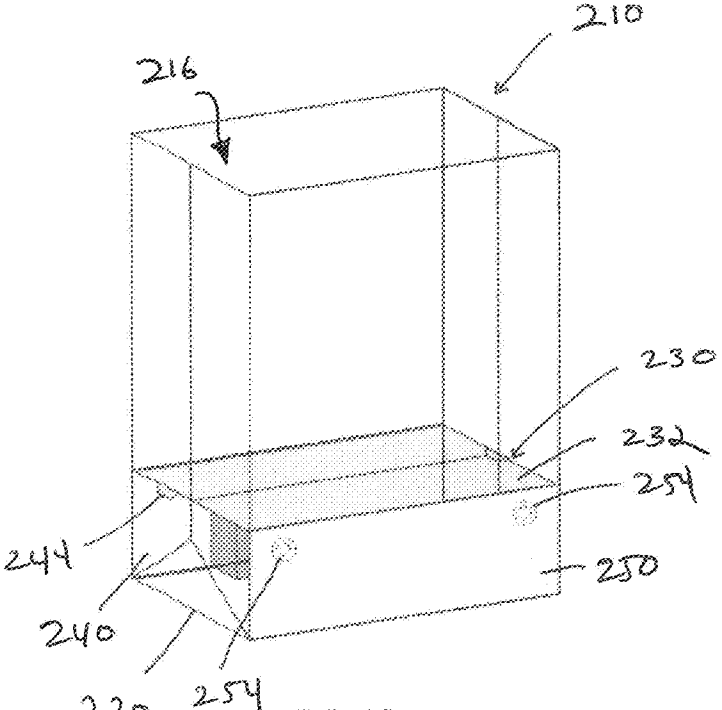
FIG. 16 depicts the insert of FIG. 15 installed in the bag of FIG. 9, with the bag depicted in phantom for clarity purposes.
Figure 18:
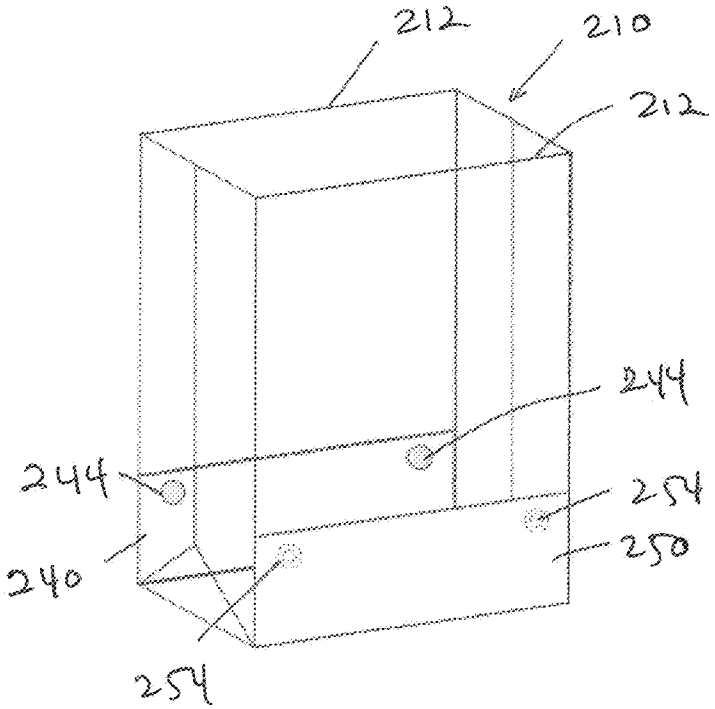
FIG. 18 depicts the insert of FIG. 15 with the panel portion entirely removed, with the bag depicted in phantom for clarity purposes.
Figures 19A, 19B, 19C, 19D, 19E, 19F:
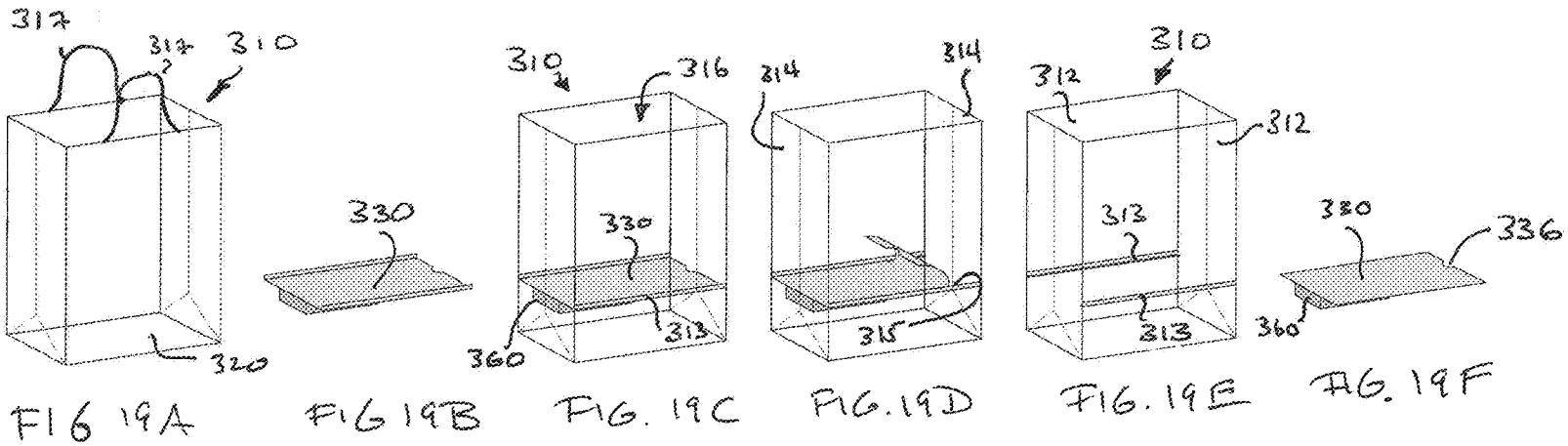
FIGS. 19A-19F depict a bag and insert according to another embodiment of the present invention.

FIG. 14 depicts an alternate embodiment of a bag 210 that incorporates fastening means 213 in the form of one part of a snap connector on each of the length sides 212 of the cavity 216 of the bag 210. As will be appreciated, these connectors may be secured directly to the length sides 212 or may be located within envelopes or pockets configured to receive legs of an insert. FIGS. 15-18 depict an insert 230 with compartment 260 compatible with the bag 210, in accordance with an embodiment. The attachment mechanisms 244, 254 on the first insert leg 240 and the second insert leg 250, have the complementary portion of the snap connector to releasably secure the first insert leg 240 and the second insert leg 250 to the fastening means 213 of the bag 210.

FIGS. 19A-19F depict yet another embodiment of the invention. Here, a bag 310 (shown with looped handles 317) includes an insert 330 without the large downwardly extending insert legs of prior embodiments. In this embodiment, the insert 330 has two edge portions 313 that are sewn into the length sides 312 in the cavity 316 of the bag 310. Of course, in other embodiments the edge portions 313 may be secured to the width sides 314 without departing from the scope of the invention. The edge portions 313 are separated from the panel portion 330 of the insert (shown with a removal notch 336) by a perforation line 315 that allows the panel portion 330 to be peeled away from the edge portions 313 and removed from the bag 310 to expose the hidden compartment 360.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

Additionally, while the dimensions and types of materials described herein are intended to define the parameters of the invention, they are by no means limiting and are exemplary embodiments. Many other embodiments will be apparent to those of skill in the art upon reviewing the above description.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. A bag having a hidden compartment comprising:

a plurality of sides connected to a bottom portion, the sides and bottom portion forming an interior cavity of the bag;

an insert secured to a least one side of the bag within the interior cavity via an attachment mechanism, the insert having an upper surface, an underside surface, and a panel portion that is removable from the insert via one or more tear lines;

a compartment secured to the underside surface of the insert; and wherein the panel portion forms a removable false bag bottom and hides the compartment from view.

2. The bag of claim 1 wherein the insert includes two insert legs, the insert legs located on opposite sides of the panel portion and connected to the panel portion by tear lines, the insert legs being substantially perpendicular to the panel portion within the cavity.

3. The bag of claim 2 wherein the attachment mechanism is at least one adhesive strip located on at least one insert leg and/or on at least one side of the bag that contacts an insert leg in the interior cavity of the bag.

4. The bag of claim 2 wherein the attachment mechanism is at least one hook and loop connector, a portion of which is located on an insert leg and a complementary portion located a side of the bag in the interior cavity.

5. The bag of claim 2 wherein the attachment mechanism is at least one snap connector, a portion of which is located on an insert leg and a complementary portion is located on a side of the bag in the interior cavity.

6. The bag of claim 1 wherein the insert includes two edge portions, the edge portions located on opposite sides of the panel portion and connected to the panel portion by tear lines; and wherein the edge portions of the insert are sewn into the sides of the cavity thereby attaching the insert to the interior cavity of the bag.

7. The bag of claim 6 wherein the tear lines include a series of perforations.

8. The bag of claim 1 wherein the tear lines include a series of perforations.

9. The bag of claim 1 wherein the insert includes a central fold in the panel portion dividing the insert into two substantially equal halves and allowing the insert to be collapsed when removed from the bag.

10. The bag of claim 1 wherein the panel portion of the insert includes a notch facilitating removal of the panel portion via the tear lines.

11. The bag of claim 1 wherein the compartment is selectively removable from the underside surface of the insert.

12. The bag of claim 1 wherein the bag is reusable.

13. The bag of claim 2 further wherein the bag includes at least one pocket having an interior configured to receive a leg of the insert, the pocket interior including an attachment mechanism.

14. The bag of claim 1 further comprising:

at least one handle secured to a side of the bag.

* * * * *